US005365644A

United States Patent [19]

Nabulon

[11] Patent Number: 5,365,644

[45] Date of Patent: Nov. 22, 1994

[54] APPARATUS FOR CONTINUOUSLY CRIMPING THERMOPLASTIC THREADS

[75] Inventor: Werner Nabulon, Rüdlingen, Switzerland

[73] Assignee: Maschinenfabrik Rieter AG, Winterthur, Switzerland

[21] Appl. No.: 63,324

[22] Filed: May 19, 1993

[30] Foreign Application Priority Data

May 20, 1992 [CH] Switzerland ..... 01613/92-4

[51] Int. Cl.[5] ..... D02G 1/12

[52] U.S. Cl. ..... 28/263; 28/221

[58] Field of Search ..... 28/221, 250, 254, 255, 28/256, 257, 258, 262, 263, 264, 247

[56] References Cited

U.S. PATENT DOCUMENTS

| | | | |
|---|---|---|---|
| 4,030,169 | 6/1977 | Enneking et al. | 28/256 |
| 4,103,404 | 8/1978 | Bäcker et al. | 28/263 |
| 4,450,607 | 5/1984 | Li et al. | 28/257 |
| 4,877,570 | 10/1989 | Nabulon | 28/257 |
| 4,974,302 | 12/1990 | Nabulon | 28/256 |

FOREIGN PATENT DOCUMENTS

| | | | |
|---|---|---|---|
| 0310890 | 4/1989 | European Pat. Off. . | |
| 2301615 | 9/1976 | France | 28/256 |
| 502983 | 4/1976 | U.S.S.R. | 28/263 |

*Primary Examiner*—Clifford D. Crowder
*Assistant Examiner*—Larry D. Worrell, Jr.
*Attorney, Agent, or Firm*—Sandler Greenblum & Bernstein

[57] ABSTRACT

A crimping apparatus for the continuous crimping of thermoplastic threads has a crimping nozzle with a feed channel, a nozzle orifice and a guide fork comprising two guide members and a plug feed roller with two parallel, interrupted, lateral guide means passing around its circumference, wherein the crimping nozzle and plug feed roller are positioned in such a way that, in a plug formation area following the nozzle orifice of the feed channel, a stuffer box is formed by the two lateral guide means and the two guide members of the guide fork, such that the thread is moved under pressure through the feed channel by means of a pressurized feed medium, which expands upon passing out of the nozzle orifice, wherein, in order to ensure an all-sided, rapid and uniform escape of the feed medium and a minimum friction surface between plugs and the stationary members bounding the stuffer box, the guide members of the guide fork are in the form of rows of spaced partial members, whose gaps extend parallel to the direction of movement of the rows of the spaced partial plug members.

16 Claims, 2 Drawing Sheets

APPARATUS FOR CONTINUOUSLY CRIMPING THERMOPLASTIC THREADS

CROSS REFERENCE TO RELATED APPLICATIONS

This application claims the priority of Swiss Application No. 01 613/92-4, filed May 20, 1992, the disclosure of which is incorporated herein by reference in its entirety.

This application is also related to commonly assigned U.S. Pat. No. 4,877,570, issued Oct. 31, 1989 and U.S. Pat. No. 4,974,302, issued Dec. 4, 1990, the disclosures of which are incorporated in their entirety herein by reference.

BACKGROUND OF THE INVENTION

1. Field of the Invention

The invention is in the field of textile technology and relates to an apparatus which is used for the continuous crimping of threads made from thermoplastic material.

2. Discussion of the Background of the Invention and Material Information

During the continuous crimping of threads (fibril bundles) made from thermoplastic material, they are e.g. moved through a feed channel with the aid of a pressurized, flowing, hot feed medium, heated and then fed through a nozzle orifice into a stuffer box, the latter being designed in such a way that the feed medium is expanded on passing out of the nozzle orifice. In the stuffer box the thread strikes against a plug formed from thread previously passed out of the orifice and thus crimping occurs. The plug is then conveyed in the feed channel at a speed lower than the thread speed and is cooled and, in the further process is loosened or opened to form a textured yarn.

European patent document No. 310890, as well as cognate U.S. Pat. Nos. 4,877,570 and 4,974,302, also assigned to the assignee of the present invention, e.g. describe a process and an apparatus for the continuous crimping of thermoplastic threads. The described apparatus embodiments have a crimping nozzle with a feed channel through which the thread is fed with the aid of a flowing medium against a nozzle orifice and a rotary plug feed roller on which the plug is further conveyed between lateral guide means arranged on the roller circumference, e.g. rows of radially positioned needles. The crimping nozzle is arranged with the nozzle orifice against the plug feed roller and substantially tangentially thereto. Directly outside the nozzle orifice the plug is formed in a stuffer box through stationary guide means, located in the vicinity of the orifice and the lateral guide means, and moved toward the plug feed roller. The plug forming in this stuffer box is defined in such a way that it is positioned between the lateral guide means without coming into contact with the plug feed roller and without extending radially over the guide means. The plug passing out of the stuffer box is so stable that the axial guidance of the lateral guide means is sufficient for its further transfer in the same position.

It has been found that it is important, for the quality of the yarn produced, that the feed medium expands as rapidly as possible, after passing out of the nozzle orifice, i.e. the stuffer box must be well vented. Particularly, in the case of high thread speeds, venting may prove inadequate and there is a negative influence on yarn quality.

SUMMARY OF THE INVENTION

The task or object of the present invention is to improve the apparatus for the continuous crimping of thermoplastic threads with respect to the venting of the stuffer box. However, the apparatus must not be more complicated or more expensive to operate and maintain.

This object is achieved by an apparatus for the continuous crimping of thermoplastic threads having a crimping nozzle with a feed channel and a nozzle orifice and a guide fork, located in the vicinity of the nozzle orifice, and having a lower guide member and an upper guide member, as well as a plug feed roller with two parallel, lateral guide means passing around its circumference and through a plug formation area, the later guide means and the two guide members surrounding a stuffer box, wherein at last one of the guide members comprises a plurality of spaced parts for improving the venting of the stuffer box, with the gaps between the spaced parts being slits which are open on the side of the guide members remote from the nozzle orifice.

Preferably, the slits are parallel to the direction of a tangent on the circumference of the plug feed roller and both guide members comprise individual, spaced parts.

Specifically, the individual parts of the guide members are plates, which are juxtaposed in such a way that their narrow sides form the boundary of the stuffer box. In the vicinity of the stuffer box the plates are thicker than the area remote therefrom, while the gaps between the plates are narrower in the vicinity of the stuffer box than in the area remote therefrom.

In one embodiment of the invention at least one of the guide members comprises a row of spaced, juxtaposed needles.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS

Figure 1:
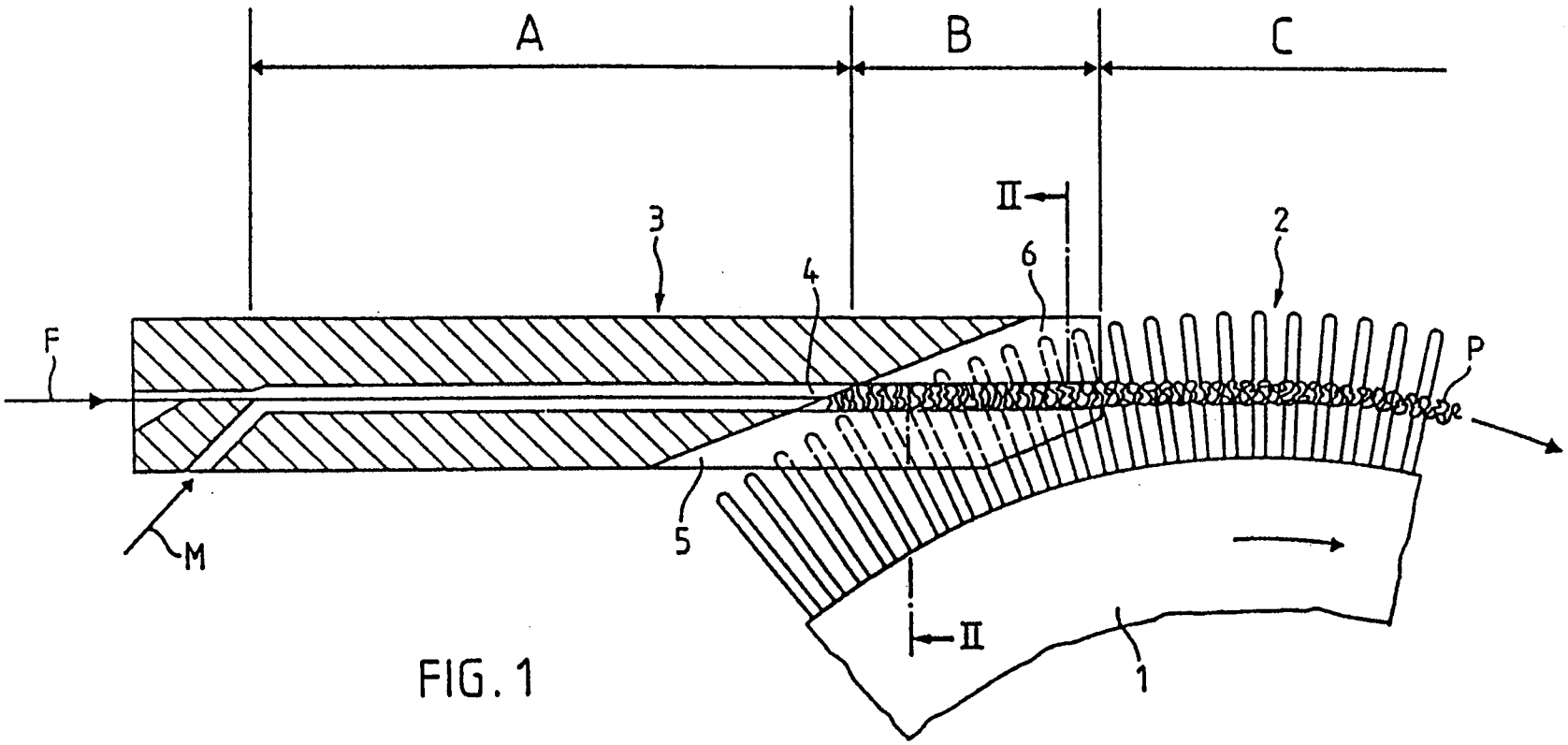
FIG. 1 schematically shows an apparatus for the continuous crimping of thermoplastic threads, in section, perpendicular to the plug feed roller axis.

FIG. 1 shows an apparatus for the continuous crimping of thermoplastic threads in a section perpendicular to the axis of a plug feed roller 1. Around its circumference the plug feed roller 1 has lateral guide means, e.g. two parallel needle rows 2, only one of which is visible in the drawing, and having plug P positioned there between. This drawing also shows a crimping nozzle 3 with a feed channel and a nozzle orifice 4 as well as a guide fork (stationary guide means), which is e.g. located adjacent to the crimping nozzle 3 in the vicinity of the orifice 4 and which comprises a lower guide member 5 and an upper guide member 6. Plug feed roller 1 and crimping nozzle 3 are positioned in such a way that the two needle rows 2 and the two guide members 5 and 6 form a stuffer box 7 (FIG. 2) running substantially tangential to plug feed roller 1 and which defines the two needle rows 2 in the axial direction of roller 1 and the two guide members 5, 6 in the radial direction thereof in such a way that the plug P passing out of stuffer box 7 is spaced from the circumferential surface of plug feed roller 1 and is located within the radial area of needle rows 2.

Crimping takes place in three areas. First, thread F is heated in heating area A, then plug P is formed in plug formation area B and is given all-sided, universal or enveloping guidance until it is sufficiently stable to be moved without enveloping guidance to the further conveying area C of plug P to additional process stages such as cooling and plug loosening or opening. The feed channel constitutes heating area A, while the stuffer box, formed by the needle rows 2 and the guide members 5 and 6, forms the plug formation area B and the channel formed by the needle rows and connected to the stuffer box forms the further conveying area C.

Figure 2:
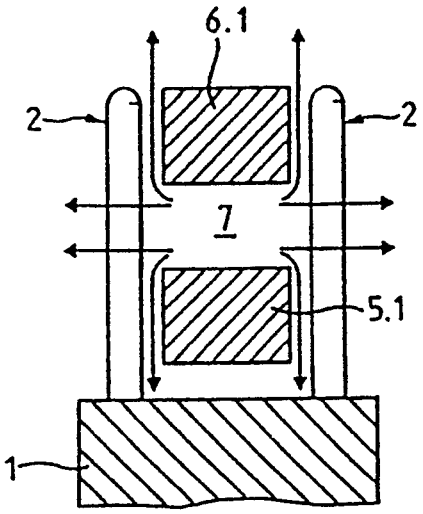
FIG. 2 PRIOR ART
FIG. 2 shows a prior art stuffer box as a section parallel to the plug feed roller axis.

FIG. 2 shows the prior art plug formation area B described in aforementioned European patent publication 310890, and cognate U.S. Pat. Nos. 4,877,570 and 4,974,302. The drawing constitutes a section through stuffer box 7, taken along arrows II in FIG. 1. This drawing once again shows plug feed roller 1 with the two needle rows 2 and between the latter the two stationary guide members 5.1 and 6.1. Each of the latter is in one piece and as a boundary or definition of the stuffer box 7 constitute compact surfaces, which define the freshly formed plug on two facing sides. On the other two sides the plug is defined by the needle rows 2. Clearly the feed medium in this embodiment and, in accordance with the arrows shown in FIG. 2, can escape between the needles of the needle rows 2 and the gaps between the needle rows and the stationary guide members. The one-piece guide members 5.1, 6.1, constitute an obstacle for the escaping medium and result in compact, stationary surfaces against which the plug rubs, which in turn are heated by the escaping medium.

Figure 3:
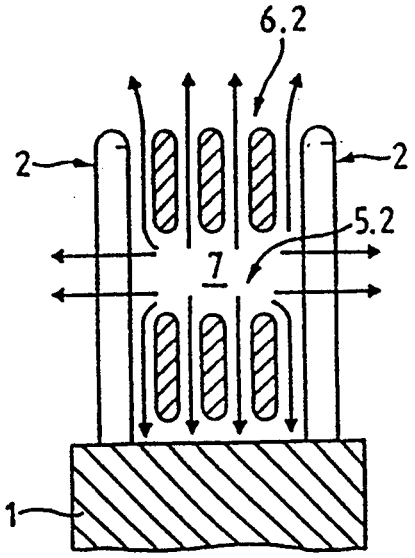
FIG. 3 discloses a first embodiment of the stuffer box of this invention.

FIG. 3 shows the plug formation area of an exemplified embodiment of the apparatus according to the invention. Here again the stuffer box 7 is laterally bounded by the two needle rows 2 and radially bounded by a lower guide member 5.2 and an upper guide member 6.2. Unlike in the case of the guide members according to FIG. 2, the guide members 5.2 and 6.2 are radially interrupted. Therefore, in accordance with the arrows shown in FIG. 3, the medium is offered more paths for expansion purposes, so that it travels over a shorter distance with the plug and the latter more rapidly comes into contact with the cool external air. As a result of this interruption of the guide surfaces it is also possible to ensure an all-sided, more uniform passing of the feed medium and consequently there is an enveloping e.g., more uniform plug cooling. At the same time, the interruptions of the guide members reduce the friction surfaces between the plug and the guide members and consequently also reduce the mechanical friction. Guide members 5.2 and 6.2 comprise individual, juxtaposed plates arranged parallel to the axis of plug feed roller 1 and gaps are provided between the plates. This embodiment also has the advantage that it is almost equivalent in regard to ruggedness as the prior art embodiment. However, it has been found that dirt can be deposited between the plates, particularly in the areas of the gaps remote from the plug and this dirt must be regularly removed if the advantages of the interrupted guide members are to be maintained.

Figure 4:
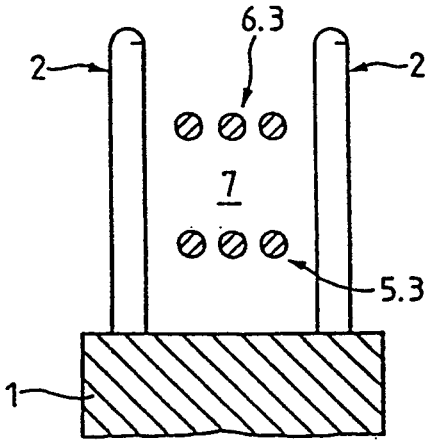
FIG. 4 discloses a second embodiment of the stuffer box of this invention.

FIG. 4 shows a further exemplified embodiment of the plug formation area of the apparatus according to the invention. It has guide members 5.3 and 6.3., which are constructed as needle rows. As individual thread loops in the forming plugs also extend between the needles and as they move in the gaps along the needles, these gaps are continuously cleaned, which eliminates the disadvantage of the FIG. 3 embodiment. However, guide members 5.3 and 6.3 are more sensitive to damage on inserting the thread and on dismantling the plug feed roller 1.

Figure 5:
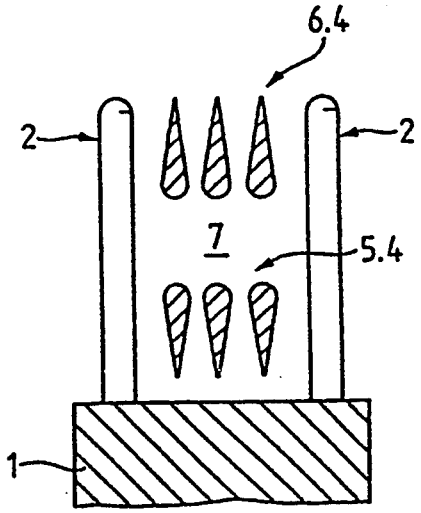
FIG. 5 discloses a third embodiment of the stuffer box of this invention.

FIG. 5 shows yet another exemplified embodiment of the plug formation area of the apparatus according to the invention. This embodiment combines the advantages of the two embodiments according to FIGS. 3 and 4. Guide members 5.4 and 6.4 are formed by plates, whose gaps become wider as these members diverge from the plug channel, thus making the plates correspondingly thinner. This embodiment ensures adequate plug guidance, so that the areas of the plate gaps that are not automatically wide enough are wide enough to make an obstruction by dirt improbable.

The described embodiments of the apparatus according to the invention merely constitute examples. Further embodiments are envisioned, in which the stuffer box side walls are not needle rows and instead are in the form of walls interrupted in any other desired manner. Further embodiments are also envisioned in which only one of the guide members interrupted, or alternatively both guide members are interrupted in different ways. In addition, other guide member part shapes are also envisioned.

While there are shown and described present preferred embodiments of the invention, it is to be distinctly understood that the invention is not limited thereto, but may be otherwise variously embodied and practiced within the scope of the following claims.

What is claimed:

1. An apparatus for the continuous crimping of thermoplastic threads comprising in combination:

a crimping nozzle, said crimping nozzle having a feed channel and a nozzle orifice;

a guide fork located axially in front of the nozzle orifice, said guide fork having a plug formation area including a lower guide member and an upper guide member;

a plug feed roller, said plug feed roller having two parallel, lateral means for guiding a plug, extending from and around the circumference of said plug feed roller, said means for guiding, extending through said plug formation area, said lateral guide means and said guide members defining the sides of a stuffer box; and wherein at least one of said guide members comprises a plurality of spaced individual parts for improving the venting of said stuffer box, with the gaps between said spaced parts being slits, said slits being open on the side of said guide members remote from said nozzle orifice.

2. The apparatus of claim 1, wherein said slits are parallel to the direction of a tangent on the circumference of said plug feed roller.

3. The apparatus of claim 1, wherein both of said guide members comprise individual, spaced parts.

4. The apparatus of claim 2, wherein both of said guide members comprise individual, spaced parts.

5. The apparatus of claim 1, wherein at least one of said guide members comprises a row of spaced, juxtaposed needles.

6. The apparatus of claim 2, wherein at least one of said guide members comprises a row of spaced, juxtaposed needles.

7. The apparatus of claim 3, wherein at least one of said guide members comprises a row of spaced, juxtaposed needles.

8. The apparatus of claim 4, wherein at least one of said guide members comprises a row of spaced, juxtaposed needles.

9. An apparatus for the continuous crimping of thermoplastic threads comprising in combination:

a crimping nozzle, said crimping nozzle having a feed channel and a nozzle orifice;

a guide fork located axially in front of the nozzle orifice, said guide fork having a plug formation area including a lower guide member and an upper guide member;

a plug feed roller, said plug feed roller having two parallel, lateral means for guiding a plug, extending from and around the circumference of said plug feed roller, said means for guiding also extending through said plug formation area, said lateral guide means and said guide members defining the sides of a stuffer box;

wherein at least one of said guide members comprises a plurality of spaced individual parts for improving the venting of said stuffer box, with the gaps between said spaced parts being slits, said slits being open on the side of said guide members remote from said nozzle orifice; and wherein the individual parts of at least one of said guide members are plates, said plates having opposed wide and narrow sides and being juxtaposed so that the narrow sides of said plates form a boundary of said stuffer box.

10. The apparatus of claim 9, wherein said slits are parallel to the direction of a tangent on the circumference of said plug feed roller.

11. The apparatus of claim 9, wherein both of said guide members comprise individual, spaced parts.

12. The apparatus of claim 10, wherein both of said guide members comprise individual, spaced parts.

13. The apparatus of claim 9, wherein in the area adjacent to said stuffer box said plates are thicker than in the area remote therefrom, while the gaps between said plates are narrower in the vicinity of the stuffer box than in the area remote therefrom.

14. The apparatus of claim 10, wherein in the area adjacent to said stuffer box said plates are thicker than in the area remote therefrom, while the gaps between said plates are narrower in the vicinity of the stuffer box than in the area remote therefrom.

15. The apparatus of claim 11, wherein in the area adjacent to said stuffer box said plates are thicker than in the area remote therefrom, while the gaps between said plates are narrower in the vicinity of the stuffer box than in the area remote therefrom.

16. The apparatus of claim 12, wherein in the area adjacent to said stuffer box said plates are thicker than in the area remote therefrom, while the gaps between said plates are narrower in the vicinity of the stuffer box than in the area remote therefrom.

* * * * *